US008503915B2

(12) United States Patent
Kimura et al.

(10) Patent No.: US 8,503,915 B2
(45) Date of Patent: Aug. 6, 2013

(54) TONER CARTRIDGE COMPRISING INTERNAL VALVE WITH FLEXIBLE SHEET MEMBER AND IMAGE FORMING APPARATUS INCLUDING THE SAME

(75) Inventors: Satoshi Kimura, Osaka (JP); Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 279 days.

(21) Appl. No.: 12/898,841

(22) Filed: Oct. 6, 2010

(65) Prior Publication Data

US 2011/0081171 A1 Apr. 7, 2011

(30) Foreign Application Priority Data

Oct. 7, 2009 (JP) ..... 2009-233875

(51) Int. Cl.
*G03G 15/08* (2006.01)

(52) U.S. Cl.
USPC ..... 399/263

(58) Field of Classification Search
USPC ..... 399/263, 262, 256, 260
See application file for complete search history.

(56) References Cited

U.S. PATENT DOCUMENTS

| | | | | |
|---|---|---|---|---|
| 4,967,691 | A * | 11/1990 | Chikama et al. | 399/62 |
| 7,483,660 | B2 * | 1/2009 | Tazawa et al. | 399/263 |
| 8,340,556 | B2 * | 12/2012 | Kunihiro et al. | 399/263 |
| 2002/0021919 | A1 | 2/2002 | Tamaki et al. | |
| 2004/0091288 | A1 * | 5/2004 | Yahagi | 399/258 |
| 2007/0280741 | A1 * | 12/2007 | Tanaka | 399/258 |
| 2008/0279594 | A1 * | 11/2008 | Sakoh et al. | 399/262 |

FOREIGN PATENT DOCUMENTS

| | | |
|---|---|---|
| JP | 03-064782 | 3/1991 |
| JP | 09-134073 | 5/1997 |
| JP | 09-292808 | 11/1997 |
| JP | 2000-315007 | 11/2000 |
| JP | 2001-083802 | 3/2001 |
| JP | 2002-23477 | 1/2002 |
| JP | 2003-280343 | 10/2003 |
| JP | 2008-216360 | 9/2008 |
| JP | 2008-276077 | 11/2008 |

* cited by examiner

*Primary Examiner* — Quana M Grainger
(74) *Attorney, Agent, or Firm* — Renner, Otto, Boisselle & Sklar, LLP

(57) ABSTRACT

A toner cartridge includes a toner container that contains a toner, an auger screw, a toner discharge port, a shutter, an internal opening/closing valve and a stirring paddle. The internal opening/closing valve is provided as a member for closing the toner discharge port, in addition to the shutter. The shutter is fixed to a position at which the toner discharge port is always opened in a state where the toner cartridge is mounted in the image forming apparatus. The internal opening/closing valve is provided at a position facing the toner discharge port of a driving side end of a rotation shaft of the auger screw. The internal opening/closing valve is composed of a rectangular sheet member having flexibility, and closes the toner discharge port by blocking the entire toner discharge port.

5 Claims, 5 Drawing Sheets

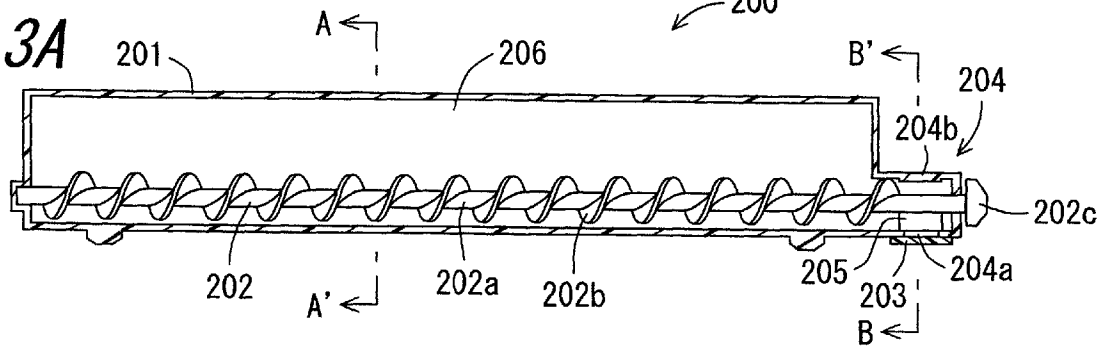
FIG. 3A
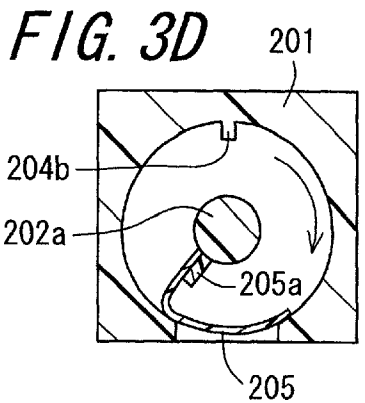
FIG. 3B
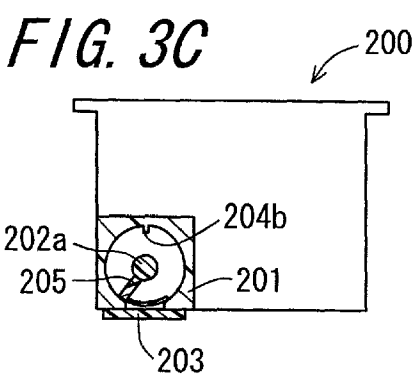
FIG. 3C
FIG. 3D

TONER CARTRIDGE COMPRISING INTERNAL VALVE WITH FLEXIBLE SHEET MEMBER AND IMAGE FORMING APPARATUS INCLUDING THE SAME

CROSS-REFERENCE TO RELATED APPLICATION

This application claims priority to Japanese Patent Application No. 2009-233875, which was filed on Oct. 7, 2009, the content of which is incorporated herein by reference in its entirety.

BACKGROUND OF THE INVENTION

1. Field of the Invention

The present invention relates to a toner cartridge for use in an image forming apparatus such as a laser beam printer or a multi-functional peripheral, particularly to a toner cartridge for containing a toner disposed so as to be exchangeable such as a toner hopper and a toner bottle, and an image forming apparatus using the same.

2. Description of the Related Art

An image forming processing using electrostatic electrophotography is generally composed of respective steps of charging, exposure, developing, transfer, cleaning, charge-removing and fixing. At a step of forming an image, for example, a surface of photoreceptor that is rotationally driven by a charging device is uniformly charged, and the surface of the photoreceptor charged by an exposure device is subjected to irradiation of a laser beam, then an electrostatic latent image is formed. Subsequently, the electrostatic latent image on the photoreceptor is developed by a developing device, and a toner image is formed on the surface of the photoreceptor. The toner image on the photoreceptor is transferred onto a printing paper sheet by a transfer device, then heated by a fixing device, and the toner image is thereby fixed on the printing paper sheet. Further, a residual toner remained on the surface of the photoreceptor after transfer is removed by a cleaning device and collected by a predetermined collecting section, while a residual charge is removed with a charge-removing device from the surface of the photoreceptor after cleaning for preparing for next image formation.

As a developer that develops an electrostatic latent image on a photoreceptor, a one-component developer composed of only a toner or a two-component developer composed of a toner and a carrier is used. The one-component carrier does not need a stirring mechanism and the like for mixing a toner and a carrier uniformly due to no use of a carrier, and thus has an advantage such that a configuration of a developing device is simplified, however, has a disadvantage such that a charging amount of a toner is hardly stabilized due to no use of a carrier, and the like. The two-component developer has a disadvantage in which the stirring mechanism and the like for mixing a toner and a carrier uniformly are required for mixing a toner and a carrier uniformly so that a developing device is complicated, however, is often used for an image forming apparatus for high-speed printing and a color image forming apparatus because of having excellent stability of a charging amount and excellent conformity to high-speed printing.

Recently, in response to a request of a user for low-power consumption and a high quality image, a toner with a small particle size such that a softening temperature is low and a volume average particle size is 5 to 9 μm is often used. Such a toner enables fixing at a low temperature and is effective for high definition and a high quality image including reduction of granularity, however, a toner aggregation is easily generated due to low fluidity of the toner.

Particularly, there is a problem that an external additive of a toner is immersed inside a particle and the fluidity of the toner is thereby extremely lowered due to friction with a sponge-like supply roller that is used as a toner discharge member of a toner cartridge.

To counter this problem, for example, as described in Japanese Unexamined Patent Publication JP-A 2001-83802 and Japanese Unexamined Patent Publication JP-A 2008-216360, by using a screw-type toner discharge member in place of the sponge-like supply roller, it is possible to reduce friction between a supply member and a toner.

However, there is a problem that when the screw-type toner discharge member as described in JP-A 2001-83802 and JP-A 2008-216360 is used, in the case where any vibration is applied to a toner cartridge, a phenomenon such that a toner is unexpectedly flowed out from a cartridge, a so-called toner avalanche, occurs even when the toner discharge member is not in a state of being rotationally driven, not at the time of toner replenishment.

Brief description will be given for the toner avalanche. While the toner discharge member is stopped, a toner in a toner cartridge is in a state where a slope face near a discharge port is kept at an inclination angle that is an approximately repose angle, and when vibration is applied thereto, the entire toner starts to flow so that aerosol in which air and a toner are mixed falls from the discharge port like an avalanche.

SUMMARY OF THE INVENTION

An object of the invention is to provide a toner cartridge capable of preventing a toner from unexpectedly flowing out. Another object of the invention is to provide an image forming apparatus including the same.

The invention provides a toner cartridge comprising:

a container for containing a toner, provided with a discharge port for discharging the contained toner;

an auger screw including a rotation shaft and a spiral blade, the auger screw being rotatably supported in the container so that the contained toner is conveyed toward the discharge port; and an opening/closing member fixed to the rotation shaft of the auger screw to open and close the discharge port in conjunction with rotation of the rotation shaft, the opening/closing member being composed of a sheet member having flexibility.

According to the invention, a discharge port for discharging a contained toner is provided in a container, and the contained toner is conveyed toward the discharge port by an auger screw. An opening/closing member is fixed to a rotation shaft of the auger screw, and opens and closes the discharge port in conjunction with rotation of the rotation shaft. An opening/closing member is composed of a sheet member having flexibility.

Opening and closing of the discharge port by the opening/closing member are performed in conjunction with rotation of the auger screw, and therefore the discharge port is able to be closed in a state where the auger screw is stopped so that it is possible to prevent a toner from unexpectedly flowing out. Moreover, a mechanism is not necessary for driving the opening/closing member, and the toner cartridge is easily downsized. An opening/closing member is composed of a sheet member having flexibility, and is able to scrape out a toner that adheres to the circumference of the discharge port along with rotation of the rotation shaft. Accordingly, it is possible to prevent the toner that adheres to the circumference of the discharge port from falling due to vibration and the like at the time of stop of rotation of the auger screw.

Further, in the invention, it is preferable that the opening/closing member is composed of a rectangular sheet member having flexibility, and is fixed at a position of the rotation shaft facing the discharge port such that a short side thereof is parallel to an axial direction of the rotation shaft and a long side thereof extends along a radial direction of the rotation shaft.

According to the invention, the opening/closing member is composed of a rectangular sheet member having flexibility and is fixed at a position of the rotation shaft facing the discharge port. Additionally, the opening/closing member is fixed such that a short side of the sheet member is parallel to an axial direction of the rotation shaft and a long side thereof extends along a radial direction of the rotation shaft.

The sheet member is a member having flexibility and is able to scrape out a toner that adheres to the circumference of the discharge port along with rotation of the rotation shaft. Accordingly, it is possible to prevent the toner that adheres to the circumference of the discharge port from falling due to vibration and the like at the time of stop of rotation of the auger screw.

Further, in the invention, it is preferable that the toner cartridge includes a projection that protrudes toward the rotation shaft on an upper side of a vertical direction with respect to a fixation position of the opening/closing member and is provided so as to come into contact with the opening/closing member at the time of rotation of the opening/closing member.

According to the invention, a projection that protrudes toward the rotation shaft on an upper side of a vertical direction with respect to a fixation position of the opening/closing member is provided. Moreover, such a projection is provided so as to come into contact with the opening/closing member at the time of rotation of the opening/closing member.

The projection and the opening/closing member come into contact with each other on the upper side of the vertical direction, thereby vibrating the opening/closing member, so that a toner that adheres to the opening/closing member is able to be removed. This makes it possible to prevent the toner that adheres to the opening/closing member from falling at the time of stop of rotation of the auger screw.

Further, in the invention, it is preferable that the projection is a bar-shaped projection provided parallel to the rotation shaft.

According to the invention, the projection is a bar-shaped projection provided parallel to the rotation shaft. This makes it possible to prevent a thin plate of the opening/closing member from locally becoming worn due to contact with the projection.

The invention provides an image forming apparatus comprising:

a photoreceptor drum on which an electrostatic latent image is to be formed;

a developing device for developing a toner image by supplying toner to the electrostatic latent image formed on the photoreceptor drum;

the toner cartridge mentioned above, for supplying toner to the developing device;

a transfer device for transferring on a recording medium the toner image developed on the photoreceptor drum; and a fixing device for fixing the transferred toner image on the recording medium.

According to the invention, an electrostatic latent image is formed on the surface of the photoreceptor drum and the electrostatic latent image is developed with a developing device. The above-described toner cartridge replenishes a toner to the developing device.

A transfer device transfers a toner image developed on the surface of the photoreceptor drum onto a recording medium, and a fixing device fixes the transferred toner image on the recording medium.

By providing the above-described toner cartridge, a toner is able to be prevented from unexpectedly flowing out so that for an image forming apparatus, toner concentration is able to be stably controlled and stable image concentration is able to be obtained over a long period of time.

BRIEF DESCRIPTION OF THE DRAWINGS

Other and further objects, features, and advantages of the invention will be more explicit from the following detailed description taken with reference to the drawings wherein:

FIGS. 3A to 3D are sectional views showing a configuration of the toner cartridge;

DETAILED DESCRIPTION

Figure 1:
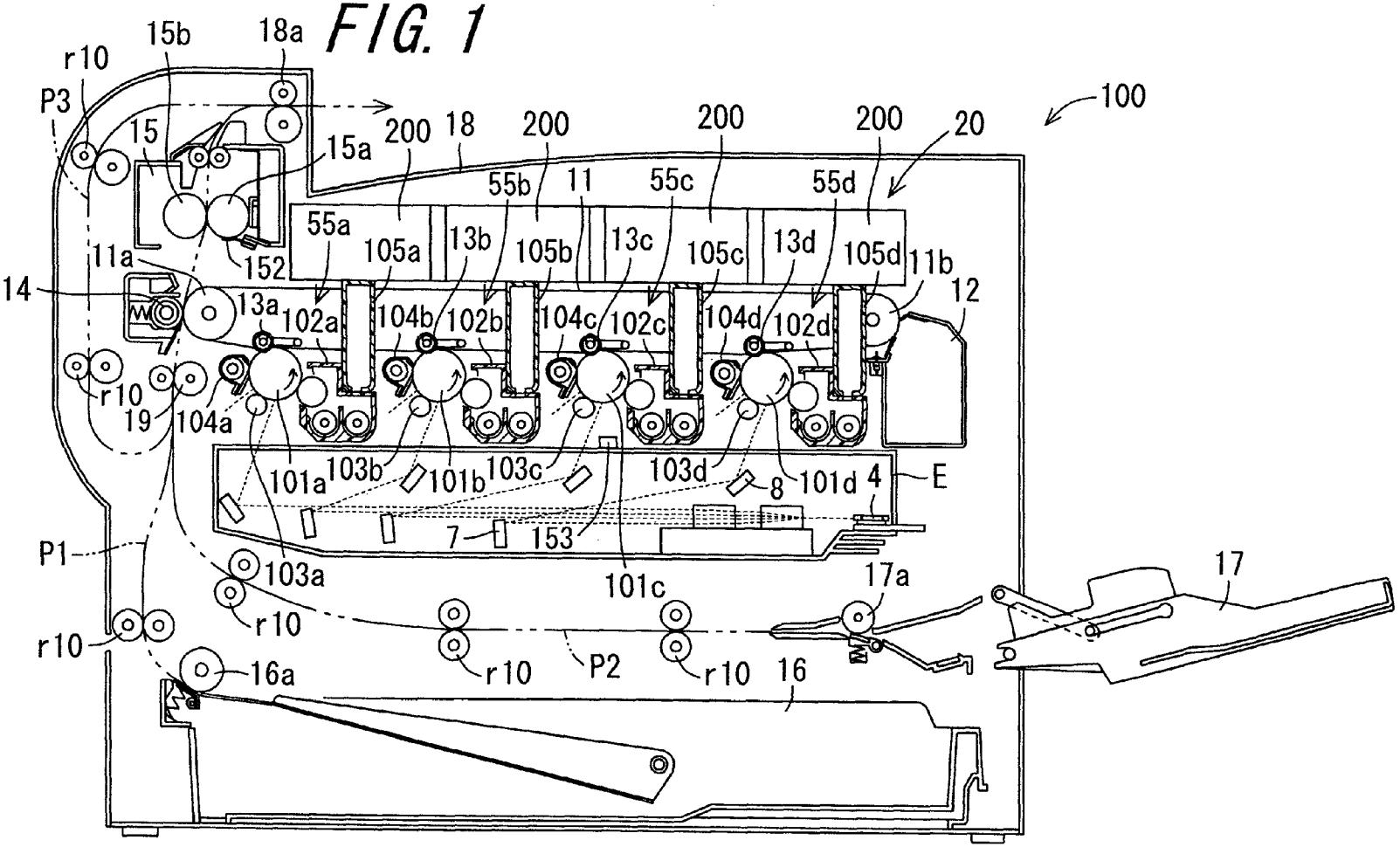
FIG. 1 is an illustrative diagram showing an entire configuration of an image forming apparatus according to an embodiment of the invention.

Now referring to the drawings, preferred embodiments of the invention are described below.

FIG. 1 is an illustrative diagram showing an entire configuration of an image forming apparatus 100 according to an embodiment of the invention.

The image forming apparatus 100 according to the embodiment includes, as shown in FIG. 1, a photoreceptor drum 101 on which an electrostatic latent image is to be formed, a developing device 102 that forms a toner image by supplying a toner to the electrostatic latent image on the surface of the photoreceptor drums 101, a toner cartridge 200 that replenishes a toner to the developing device 102 via a toner replenishment pipe 105, a secondary transfer roller (transfer device) 14 that transfers the toner image on the photoreceptor drum 101 to a paper sheet via an intermediate transfer belt 11, and a fixing device 15 that fixes the toner image on the paper sheet. In the image forming apparatus 100 that forms an image with use of a toner by electrophotography, a configuration of a toner cartridge according to the invention is employed for the toner cartridge 200.

First, description will be given for an entire configuration of the image forming apparatus 100.

The image forming apparatus 100 according to the embodiment is to form a multicolored or monochromatic image on a predetermined sheet (printing paper sheet) as a visible image based on image data transmitted from an external apparatus via a communication network or the like. The image forming apparatus 100 includes, as shown in FIG. 1, an exposure unit E, photoreceptor drums 101 (101*a*, 101*b*, 101*c* and 101*d*) corresponding to an image bearing member on which a latent image is to be formed by the exposure unit E, developing devices 102 (102*a*, 102*b*, 102*c* and 102*d*), charging rollers 103 (103*a*, 103*b*, 103*c* and 103*d*), cleaning units 104 (104*a*, 104*b*1 104*c* and 104*d*), an intermediate transfer belt 11, primary transfer rollers 13 (13*a*, 13*b*, 13*c* and 13*d*), a secondary transfer roller 14, a fixing device 15, paper conveyance paths P1, P2 and P3, paper feeding cassette 16, a manual paper feeding tray 17, a paper discharge tray 18, a toner cartridge unit 20 and the like.

Image data of a color image which is dealt in the image forming apparatus 100 is image data corresponding to each color of four colors including black (K), cyan (C), magenta (M) and yellow (Y), and formation of a visible image is performed in image forming sections 55 (55*a*, 55*b*, 55*c* and 55*d*) based on the image data. The developing devices 102 (102*a* to 102*d*), the photoreceptor drums 101 (101*a* to 101*d*), the charging rollers 103 (103*a* to 103*d*) and the cleaning units 104 (104*a* to 104*d*) are provided by four pieces respectively so that four kinds of latent images corresponding to the respective colors are formed.

Each of the image forming sections 55*a* to 55*d* is configured all the same, and for example, a black image forming section 55*a* comprises a photoreceptor drum 101*a*, a developing device 102*a*, a charging roller 103*a*, a transfer roller 13*a*, and a cleaning unit 104*a*.

The image forming sections 55*a* to 55*d* are arrayed in a line along a moving direction (sub-scanning direction) of the intermediate transfer belt 11. Note that, for the above-described reference symbols of "a" to "d", "a" corresponds to black, "b" corresponds to cyan, "c" corresponds to magenta, and "d" corresponds to yellow, and four image stations are configured with the above-described respective sections distinguished by these reference symbols.

The exposure unit E which is the exposure device of the embodiment includes a semiconductor laser (not shown), a polygonal mirror 4, first reflection mirrors 7, and second reflection mirrors 8, etc., and each of the photoreceptor drums 101*a* to 101*d* is irradiated with each light beam such as laser beam, modulated with the image data of each color of black, cyan, magenta and yellow. To each of the photoreceptor drums 101*a* to 101*d*, an electrostatic latent image by the image data of each color of black, cyan, magenta and yellow is formed.

In the embodiment, although the exposure unit E is one having a technique using a laser scanning unit (LSU) including a laser irradiation section and a reflection mirror, one having a technique in which light emitting elements are arranged in an array using EL or LED writing head, for example, may be used.

The photoreceptor drum 101 is arranged above the exposure unit E, is image bearing members each having a substantially cylinder shape, and is controlled to rotate in a predetermined direction by a drive section and a control section which are not shown. The photoreceptor drum 101 is so configured that a photoconductive layer is formed on a conductive substrate. For example, a metal drum made of aluminum or the like is the substrate, and on the outer circumferential surface thereof, the photoconductive layer of amorphous silicon (a-Si), selenium (Se), or organic photosemiconductor (OPC) etc., is formed as a thin film. Note that, the configuration of the photoreceptor drum 101 is not particularly limited to the above-described configuration.

The charging roller 103 is a charging device of contact type which charges the surface of the photoreceptor drum 101 uniformly to predetermined potential. In the embodiment, as shown in FIG. 1, although the charging roller 103 of roller type and contact type is used as the charging device, in replacement of such a charging roller 103, a charging device of charger type or brush type may be used.

The developing device 102 supplies a toner to the surface of the photoreceptor drum 101 on which the electrostatic latent image is formed, to develop the electrostatic latent image to the toner image. Each of the developing devices 102*a* to 102*d* contains a toner of each of the colors of black, cyan, magenta, and yellow, and visualize the electrostatic latent image corresponding to each of the colors formed on each of the surfaces of the photoreceptor drums 101*a* to 101*d* into the toner image of each of the colors of black, cyan, magenta and yellow.

The cleaning unit 104 removes and collects a residual toner on the surface of the photoreceptor drum 101 with a lubricant or the like after development and image transfer.

The intermediate transfer belt 11 arranged above the photoreceptor drum 101 is supported around a driving roller 11*a* and a driven roller 11*b* with tension to form a loop-like moving path. An outer circumferential surface of the intermediate transfer belt 11 faces a photoreceptor drum 101*d*, a photoreceptor drum 101*c*, a photoreceptor drum 101*b* and a photoreceptor drum 101*a*, in this order.

The primary transfer rollers 13*a* to 13*d* are arranged at positions facing the respective photoreceptor drums 101*a* to 101*d* with the intermediate transfer belt 11 interposed therebetween. The respective positions at which the intermediate transfer belt 11 faces the photoreceptor drums 101*a* to 101*d* are primary transfer positions. The intermediate transfer belt 11 is a film having a thickness of about 100 to 150 μm, and formed to be an endless-shape.

A primary transfer bias having opposite polarity to charging polarity of the toner is applied by constant voltage control to the primary transfer rollers 13*a* to 13*d* in order to transfer the toner images borne on the surfaces of the photoreceptor drums 101*a* to 101*d* onto the intermediate transfer belt 11. Thereby, the toner images of the respective colors formed on the photoreceptor drums 101 (101*a* to 101*d*) are transferred and overlaid onto the outer circumferential surface of the intermediate transfer belt 11 sequentially, and a full-color toner image is formed on the outer circumferential surface of the intermediate transfer belt 11.

However, when image data for only a part of the colors of yellow, magenta, cyan and black is inputted, electrostatic latent images and toner images are formed at only a part of the photoreceptor drums 101 corresponding to the color of the input image data among the four photoreceptor drums 101*a* to 101*d*. For example, during monochrome image formation, formation of an electrostatic latent image and formation of a toner image are performed only at the photoreceptor drum 101*a* corresponding to the color of black, and only a black toner image is transferred onto the outer circumferential surface of the intermediate transfer belt 11.

Each of the primary transfer rollers 13*a* to 13*d* is configured by coating a surface of a shaft whose raw material is metal having a diameter of 8 to 10 mm (stainless steel, for example) with a conductive elastic material (such as EPDM, urethane foam, etc.), and applies high voltage uniformly to the intermediate transfer belt 18 by the conductive elastic material. In the embodiment, although the primary transfer rollers 13*a* to 13*d* are used as transfer electrodes, other than them, a brush or the like is also usable.

The toner image transferred onto the outer circumferential surface of the intermediate transfer belt 11 at each primary transfer position is conveyed to a secondary transfer position, which is a position facing the secondary transfer roller 14, by the rotation of the intermediate transfer belt 11. The secondary transfer roller 14 is in pressure-contact, at a predetermined nip pressure, with the outer circumferential surface of the intermediate transfer belt 11 whose inner circumferential surface is in contact with a circumferential surface of an intermediate transfer belt driving roller 11*a* during image formation. To obtain the nip pressure constantly, either of the secondary transfer roller 14 or the intermediate transfer belt driving roller 11*a* is formed by a hard material such as metal, and another one is formed by a soft material such as an elastic roller or the like (elastic rubber roller, foamable resin roller, etc.).

When a paper sheet fed from a paper feeding cassette 16 or a manual paper feeding tray 17 passes through between the secondary transfer roller 14 and the intermediate transfer belt 11, high voltage with opposite polarity (+) to the charging polarity of the toner (−) is applied to the secondary transfer roller 14. As described above, the electrostatic latent images formed on the surfaces of respective photoreceptor drums 101 (101*a* to 101*d*) are visualized by the toner corresponding to each of the colors to form respective toner images, and such toner images are layered on the intermediate transfer belt 11. Thereafter, the layered toner images are moved to a contact position of the conveyed paper sheet with the intermediate transfer belt 11 by the rotation movement of the intermediate transfer belt 11, and by the secondary transfer roller 14 arranged in this position, the toner images are transferred from the outer circumferential surface of the intermediate transfer belt 11 onto the paper sheet.

Toners adhered to the intermediate transfer belt 11 by the contact of the intermediate transfer belt 11 with the photoreceptor drum 101, and toners remaining on the intermediate transfer belt 11 without being transferred in transferring the toner image from the intermediate transfer belt 11 to the paper sheet become a source of causing color mixture of the toner at the next step, therefore removal and collection thereof are performed by an intermediate transfer belt cleaning unit 12. The intermediate transfer belt cleaning unit 12 is provided with, for example, a cleaning blade as a cleaning member that is in contact with the intermediate transfer belt 11. A part of the intermediate transfer belt 11 where the cleaning blade is in contact therewith is supported by an intermediate transfer belt driven roller 11*b* from a backside thereof.

The paper sheet to which a toner image is transferred as a visible image is guided by the fixing device 15 comprised of a heating roller 15*a* and a pressure roller 15*b*, passes through between the heating roller 15*a* and the pressure roller 15*b*, and subjected to the processing of heating and pressurizing. Thereby, the toner image to be the visible image is fixed firmly on the surface of the paper sheet. The paper sheet on which the toner image has been fixed is discharged by paper discharge rollers 18*a* onto the paper discharge tray 18.

The image forming apparatus 100 is provided with a paper conveyance path P1 of an approximately vertical direction in order to feed a paper sheet that is contained in the paper feeding cassette 16 to the paper discharge tray 18 by passing between the secondary transfer roller 14 and the intermediate transfer belt 11 as well as through the fixing device 15.

Arranged in the paper conveyance path P1 are a pick-up roller 16*a* for feeding the paper sheet in the paper feeding cassette 16 into the paper conveyance path P1 sheet by sheet, conveying rollers r10 for conveying the fed paper sheet upward, registration rollers 19 for guiding the conveyed paper sheet between the secondary transfer roller 14 and the intermediate transfer belt 11 at a predetermined timing, and the paper discharge rollers 18*a* for discharging the paper sheet to the paper discharge tray 18.

Moreover, inside the image forming apparatus 100, a paper conveyance path P2 on which a pick-up roller 17*a* and the conveyance rollers r10 are arranged is formed ranging from the manual paper feeding tray 17 to the registration rollers 19. Further, a paper conveyance path P3 is formed ranging from the paper discharge rollers 18*a* to an upstream side of the registration roller 19 in the paper conveyance path P1.

The paper discharge rollers 18*a* are supported in both forward and reverse directions so as to rotate freely, and is driven in a forward rotation direction to discharge a paper sheet to the paper discharge tray 18 at the time of single-sided image formation in which an image is formed on one side of the paper sheet as well as at the time of second side image formation in double-sided image formation in which an image is formed on both sides of the paper sheet.

On the other hand, at the time of a first side image formation in double-sided image formation, the discharge rollers 18*a*, after being driven in a forward rotation direction until a tail end of the paper sheet passes through the fixing device 15, drive in a reverse rotation direction in the state of holding the tail end of the paper sheet therebetween and guide the paper sheet into the paper conveyance path P3. Thereby, the paper sheet in which an image is formed only on one side in advance is guided into the paper conveyance path P1 in the state of reversing the front side and back side as well as a leading end and the tail end.

The registration rollers 19 guide the paper sheet that is fed from the paper feeding cassette 16 or the manual paper feeding tray 17, or that is conveyed through the paper conveyance path P3, between the secondary transfer roller 14 and the intermediate transfer belt 11 at a timing that synchronizes with rotation of the intermediate transfer belt 11. Therefore, the registration rollers 19 stop rotating at the start of operation of the photoreceptor drum 101 and the intermediate transfer belt 11, and the paper sheet fed or conveyed prior to rotation of the intermediate transfer belt 11 is stopped moving in the paper conveyance path P1 in the state of bringing the leading end thereof into contact with the registration rollers 19. Thereafter, the registration rollers 19 start rotating at a timing when the leading end of the paper sheet faces the leading end of a toner image formed on the intermediate transfer belt 11 at a position in which the secondary transfer roller 14 comes in pressure-contact with the intermediate transfer belt 11.

Note that, during full-color image formation in which image formation is performed by all of the image forming sections 55*a* to 55*d*, the primary transfer rollers 13*a* to 13*d* cause the intermediate transfer belt 11 to be in pressure-contact with all of the photoreceptor drums 101*a* to 101*d*. On the other hand, during monochrome image formation in which image formation is performed only by the image forming section 55*a*, only the primary transfer roller 13*a* causes the intermediate transfer belt 11 to be in pressure-contact with the photoreceptor drum 101*a*.

Figure 2:
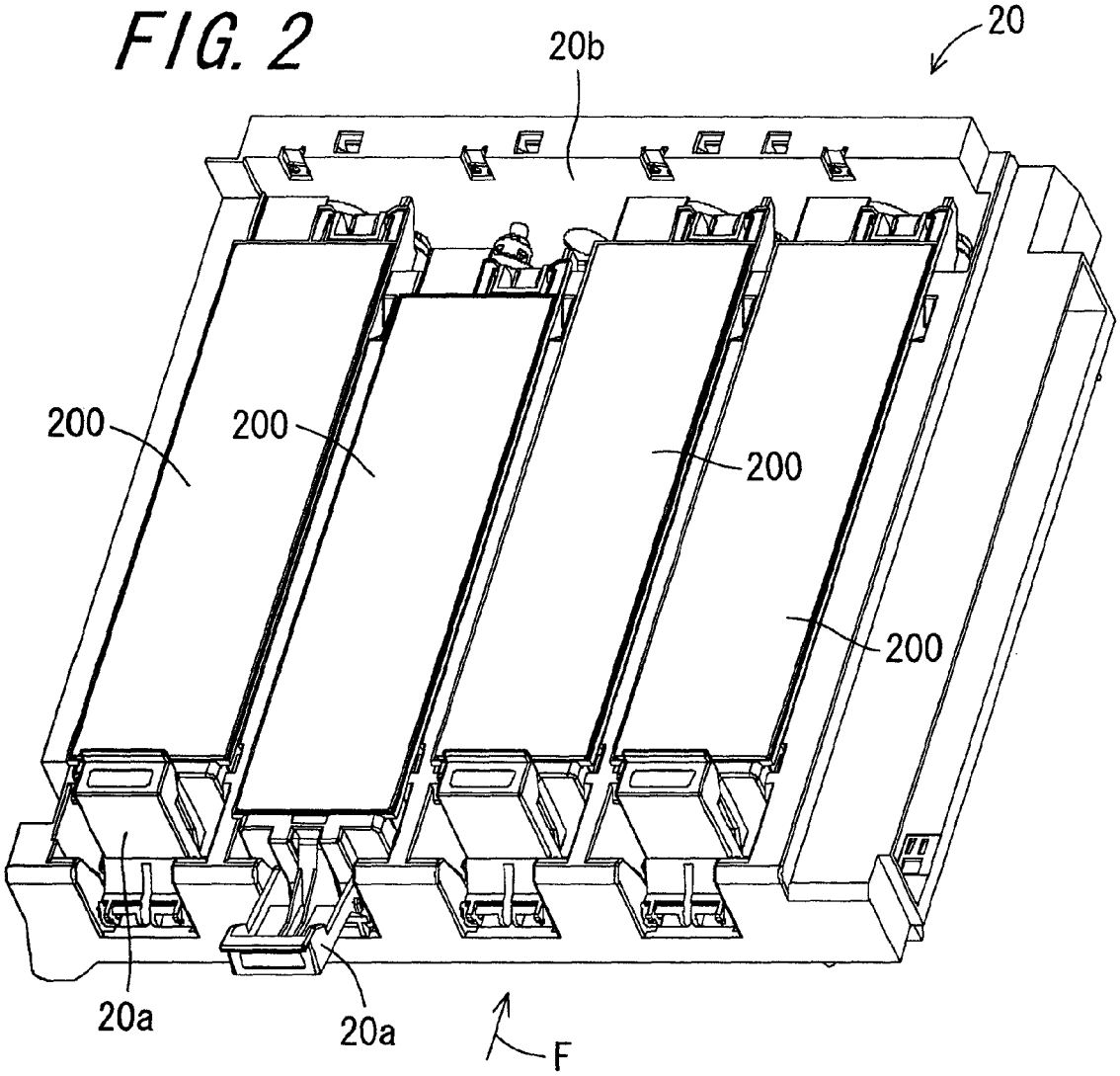
FIG. 2 is a perspective view showing a configuration of a toner cartridge unit including a toner cartridge according to the embodiment of the invention.
Figure 4A:
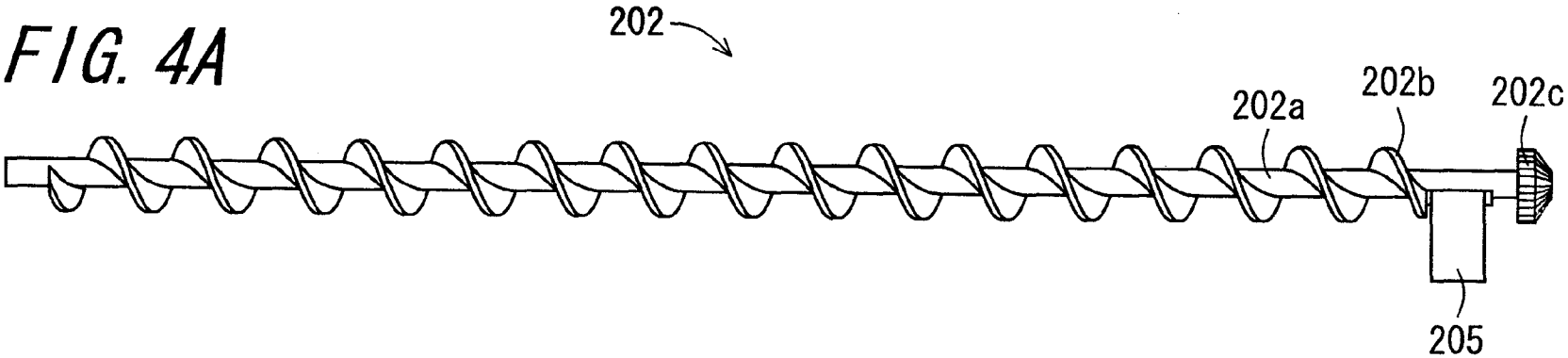
FIGS. 4A and 4B are external views showing a configuration of an auger screw.
Figure 4B:
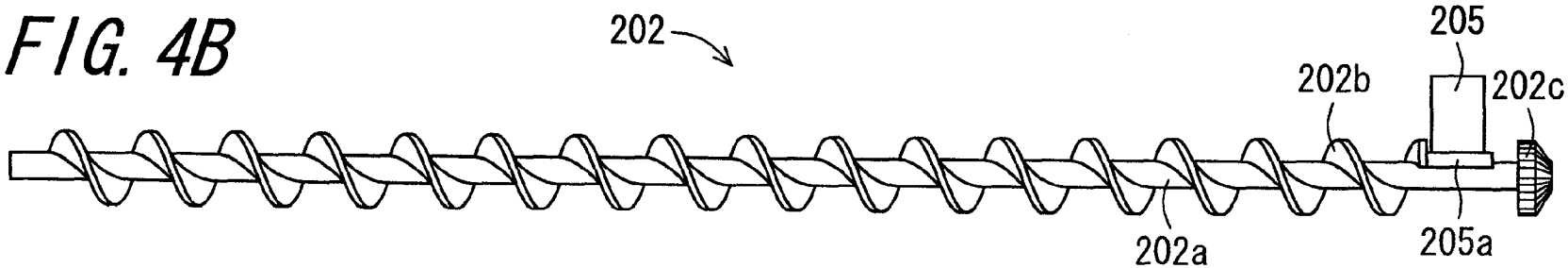
Figure 5:
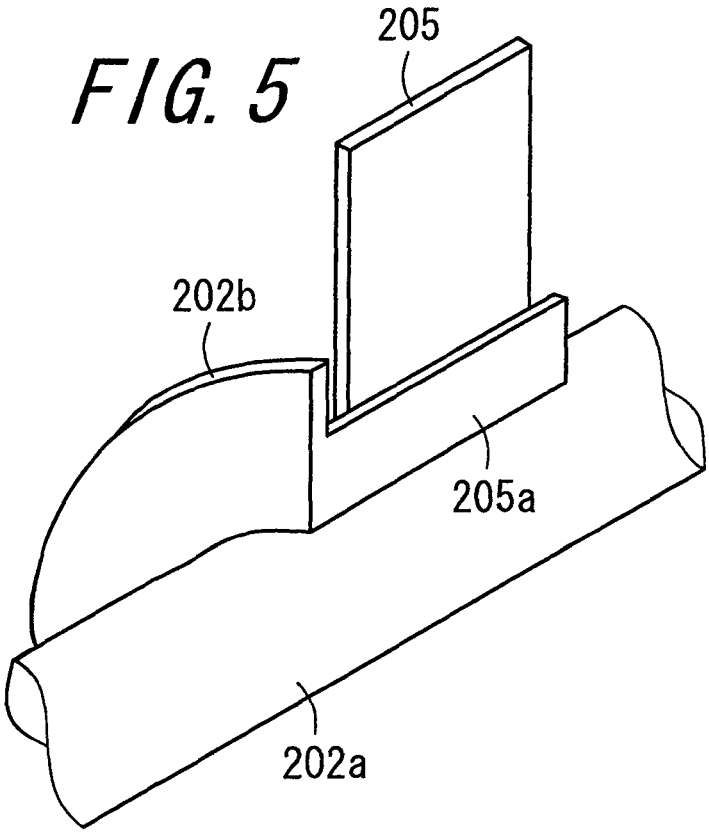
FIG. 5 is an enlarged perspective view showing an internal opening/closing valve.

FIG. 2 is a perspective view showing a configuration of a toner cartridge unit 20 including the toner cartridge 200 according to the embodiment of the invention. FIGS. 3A to 3D are sectional views showing a configuration of the toner cartridge 200. FIG. 3A shows a sectional view in a cut surface parallel to an axial direction of an auger screw 202, FIG. 3B shows a sectional view of the toner cartridge 200 taken along the line A-A', FIG. 3C shows a sectional view of the toner cartridge 200 taken along the line B-B', and FIG. 3D shows an enlarged view of an internal opening/closing valve 205. Note that, FIG. 2 shows a state before one toner cartridge 200 is mounted. FIGS. 4A and 4B are external views showing a configuration of the auger screw 202. FIG. 4A shows the auger screw 202 and the internal opening/closing valve 205, and FIG. 4B shows a state where the auger screw 202 shown in FIG. 4A is rotated 180 degrees around a rotation shaft. FIG. 5 is an enlarged perspective view showing the internal opening/closing valve 205.

Four toner cartridges 200 are arranged alongside above the toner cartridge unit 20 as shown in FIGS. 1 and 2. The toner cartridge 200 is configured so that a toner container 201 is displaced in a direction opposite to a lock lever 20*a* (arrow F direction) by raising the lock lever 20*a*, and so as to be held in the state of bringing an end of the toner container 201 into contact with a stopper plate 20*b*. In the case of displacing in this manner, the toner container 201 moves in an approximately horizontal direction above the toner replenishment pipe 105, and a shutter 203 provided on a bottom surface of the toner container 201 moves in an approximately horizontal direction. Then, when the toner container 201 is displaced to a position at which a toner discharge port 204*a* of the bottom surface of the toner container 201 faces an upper opening of the toner replenishment pipe 105, the shutter 203 is opened to be in a state where a toner is able to be replenished from the upper opening of the toner replenishment pipe 105.

The toner cartridge 200 includes, as shown in FIGS. 3A to 3D, the toner container 201 that contains a toner, the auger screw 202, the toner discharge port 204*a*, the shutter 203, the internal opening/closing valve 205 and a stirring paddle 207.

The toner container 201 is an approximately prismatic container that contains a toner, and includes an approximately cylindrical toner discharge section 204 at one end thereof. Inside the container, the auger screw 202 and the stirring paddle 207 are provided so as to rotate freely. The auger screw 202 includes a rotation shaft 202*a*, a spiral blade 202*b* and a driving gear 202*c*, and the rotation shaft 202*a* rotates around an axis thereof by applying rotation driving force to the driving gear 202*c*, thereby rotating the spiral blade 202*b*, so that a toner inside the toner container 201 is conveyed to the toner discharge port 204*a* along an axial direction of the rotation shaft 202*a*.

The stirring paddle 207 is a stirring member having four stirring blades around the rotation shaft, and configured so as to disintegrate and stir the toner contained in a toner containing section 206 by rotation. The toner discharge port 204*a* is a rectangular opening part provided on the bottom surface of the toner discharge section 204, and discharges a toner conveyed by rotation of the auger screw 202 from the toner cartridge 200.

The shutter 203 is a rectangular plate-like member slidably provided between a position at which the toner discharge port 204*a* is closed and a position at which toner discharge port 204*a* is opened. The shutter 203 is composed of a plate-like member larger than the toner discharge port 204*a* for closing the toner discharge port 204*a*, and provided on the outside of the bottom surface of the toner discharge section 204 so as to slide in an axial direction of the auger screw 202. The shutter 203 slides in conjunction with displacement of the toner cartridge 200 at the time of mounting the toner cartridge 200 in the image forming apparatus.

In the invention, it is preferable that the internal opening/closing valve 205 is provided as a member for closing the toner discharge port 204*a*, in addition to the shutter 203. The shutter 203 is fixed in a position at which the toner discharge port 204*a* is always opened in a state where the toner cartridge 200 is mounted in the image forming apparatus.

The internal opening/closing valve 205 is provided at a position facing the toner discharge port 204*a* of a driving side end of the rotation shaft 202*a* of the auger screw 202, that is, an end on the side in which the driving gear 202*c* is provided. The internal opening/closing valve 205 is composed of a rectangular sheet member whose short side is fixed to the rotation shaft 202*a*. The internal opening/closing valve 205 is fixed to the rotation shaft 202*a* so that a short side thereof is parallel to an axial direction of the rotation shaft 202*a*, and along side thereof extends in a radial direction of the rotation shaft 202*a*. The internal opening/closing valve 205 may be fixed directly to the side surface of the rotation shaft 202*a*, however, is fixed via a rectangular fixed pedestal 205*a* radially provided on the side surface of the rotation shaft 202*a* in the embodiment. As a material of the internal opening/closing valve 205, a resin material having flexibility such as PET (polyethylene terephthalate) or PP (polypropylene) whose thickness is 0.2 mm to 2 mm is able to be used, and a PET film whose thickness is 0.5 mm is used in the embodiment.

The internal opening/closing valve 205 is deformed along an inner wall of the toner discharge section 204 and blocks the entire toner discharge port 204*a*, thereby closing the toner discharge port 204*a*. The length of a long side of the internal opening/closing valve 205 is a length in which 5 to 10 mm is added to the sum of the distance from the side surface of the rotation shaft 202*a* to the inner wall of the toner discharge section 204 and the length in a circumferential direction of the toner discharge port 204*a*. Further, the length of the short side of the internal opening/closing valve 205 is a length in which 5 to 10 mm is added to the length in an axial direction of the toner discharge port 204*a*.

When the auger screw 202 is rotated, the internal opening/closing valve 205 fixed to the rotation shaft 202*a* is also rotated, and when the auger screw 202 is stopped rotating, rotation of the internal opening/closing valve 205 is also stopped. In order to prevent a toner from flowing out from the toner discharge port 204*a* in a state where the auger screw 202 stops rotating other than the time of toner replenishment and the like, the internal opening/closing valve 205 should be in a state of blocking the entire toner discharge port 204*a*. When the auger screw 202 is rotated and then stopped, the internal opening/closing valve 205 becomes the state of blocking the entire toner discharge port 204*a* when the auger screw 202 is stopped at a predetermined stop position. Such stop position is determined depending on size and a material of the internal opening/closing valve 205 as well as size and a position of the toner discharge port 204*a*, etc., and is able to be set in advance for each apparatus. Once the stop position of the auger screw 202 at which the internal opening/closing valve 205 comes to a state of blocking the entire toner discharge port 204*a* is set, when a toner should be prevented from flowing out from the toner discharge port 204*a* other than the time of toner replenishment, etc., the auger screw 202 is only stopped at the set stop position so that the toner discharge port 204*a* is able to be closed reliably.

In this manner, the toner discharge port 204*a* is able to be opened and closed from the inside only by controlling rotation of the auger screw 202, and there is thus no need for adding a driving mechanism for opening and closing.

By closing the toner discharge port 204*a* at the time of shipment of the toner cartridge 200 or at the time of stop of rotation of the auger screw 202, it is possible to prevent a toner avalanche phenomenon in which a toner near the toner discharge port 204*a* becomes aerosol at the time of stop of rotation of the auger screw 202 right after mounting the toner cartridge 200 to an image forming apparatus to run down from the toner discharge port 204*a* at once.

Additionally, by using the above-described sheet body having flexibility as the internal opening/closing valve 205, a toner that adheres to the circumference of the toner discharge port 204*a* is able to be scrapped out, so that it is possible to prevent, before happens, the toner that adheres the circumference of the toner discharge port 204*a* from falling due to vibration and the like, at the time of stop of rotation of the auger screw 202.

A projection 204*b* that protrudes inward is provided on an inner circumferential wall surface of the toner discharge section 204, facing a fixed position of the internal opening/closing valve 205 on an upper side of the vertical direction.

The projection 204*b* is provided so as to come into contact with the internal opening/closing valve 205 when the internal opening/closing valve 205 is rotated about the axis of the rotation shaft 202*a* along with rotation of the auger screw 202, and the internal opening/closing valve 205 vibrates by coming into contact with the projection 204*b*. The toner that adheres to the surface of the internal opening/closing valve 205 is scraped out due to the vibration. Moreover, the projection 204*b* is provided on the upper side of the vertical direction with respect to the rotation shaft 202*a* so that a projection thereof becomes a downward convexity, and a toner that adheres to the projection 204*b* is easily fallen.

Since the internal opening/closing valve 205 is scraped with an inner wall of the toner discharge section 204 along with rotation of the auger screw 202, a toner that adheres to the inner wall of the toner discharge section 204 may adhere to a scraped surface of the internal opening/closing valve 205. In a state where the internal opening/closing valve 205 closes the toner discharge port 204*a*, the scraped surface is exposed so that the toner that adheres to the scraped surface falls.

The projection 204*b* comes into contact with the scraped surface of the internal opening/closing valve 205 that rotates, and scrapes out the toner that adheres to the internal opening/closing valve 205 to be able to prevent the toner from falling at the time of closing of the toner discharge port 204*a*. Further, the projection 204*b* is composed of a bar-shaped projection that extends parallel to the rotation shaft 202*c*, and even in the case of coming into contact therewith for each rotation, it is possible to prevent the internal opening/closing valve 205 from locally becoming worn at the contact position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge comprising:

a container for containing a toner, provided with a discharge port for discharging the contained toner;

an auger screw including a rotation shaft and a spiral blade, the auger screw being rotatably supported in the container so that the contained toner is conveyed toward the discharge port; and an opening/closing member fixed to the rotation shaft of the auger screw to open and close the discharge port in conjunction with rotation of the rotation shaft, the opening/closing member being composed of a sheet member having flexibility, wherein the opening/closing member is composed of a rectangular sheet member having flexibility, and is fixed at a position of the rotation shaft facing the discharge port such that a short side thereof is parallel to an axial direction of the rotation shaft and a long side thereof extends along a radial direction of the rotation shaft.

2. The toner cartridge of claim 1, further comprising a projection that protrudes toward the rotation shaft on an upper side of a vertical direction with respect to a fixation position of the opening/closing member and is provided so as to come into contact with the opening/closing member at the time of rotation of the opening/closing member.

3. The toner cartridge of claim 2, wherein the projection is a bar-shaped projection provided parallel to the rotation shaft.

4. An image forming apparatus comprising:

a photoreceptor drum on which an electrostatic latent image is to be formed;

a developing device for developing a toner image by supplying toner to the electrostatic latent image formed on the photoreceptor drum;

the toner cartridge of claim 1, for supplying toner to the developing device;

a transfer device for transferring on a recording medium the toner image developed on the photoreceptor drum; and a fixing device for fixing the transferred toner image on the recording medium.

5. A toner cartridge comprising:

a container for containing a toner, provided with a discharge port for discharging the contained toner;

an auger screw including a rotation shaft and a spiral blade, the auger screw being rotatably supported in the container so that the contained toner is conveyed toward the discharge port;

a shutter provided on an outside of the container, the shutter being slidably provided between a position at which the discharge port is closed and a position at which the discharge port is closed; and an opening/closing member fixed to the rotation shaft of the auger screw to open and close the discharge port in conjunction with rotation of the rotation shaft, the opening/closing member being composed of a rectangular sheet member having flexibility, the opening/closing member being fixed at a position of the rotation shaft facing the discharge port such that a short side thereof is parallel to an axial direction of the rotation shaft and a long side thereof extends along a radial direction of the rotation shaft, a length of the long side of the opening/closing member being such a length that the opening/closing member is deformed along an inner wall of the discharge port, scrapes the inner wall of the discharge port and blocks an entire discharge port.

* * * * *